US005910082A

United States Patent [19]

Bender et al.

[11] Patent Number: 5,910,082

[45] Date of Patent: Jun. 8, 1999

[54] SOUND-ABSORBING BUILDING PANEL

[75] Inventors: Klaus Bender, Biertal; Robert Wachter; Bernd Fiedler, both of Wetzlar, all of Germany

[73] Assignee: Wilhelmi Werke AG, Lahnua, Germany

[21] Appl. No.: 08/994,291

[22] Filed: Dec. 19, 1997

[30] Foreign Application Priority Data

Dec. 21, 1996 [DE] Germany ..... 196 53 930

[51] Int. Cl.[6] ..... E04B 1/82

[52] U.S. Cl. ..... 52/144; 181/284; 181/292

[58] Field of Search ..... 52/144; 181/284, 181/292

[56] References Cited

U.S. PATENT DOCUMENTS

| | | | |
|---|---|---|---|
| 2,028,272 | 11/1936 | Burgess | 181/284 X |
| 2,923,372 | 2/1960 | Maccaferri | 181/284 |
| 4,235,303 | 11/1980 | Dhoore et al. | 181/292 X |
| 4,960,184 | 10/1990 | Woodward et al. | 52/144 X |
| 5,678,363 | 10/1997 | Ogorchock et al. | 52/144 |

FOREIGN PATENT DOCUMENTS

| | | |
|---|---|---|
| 0 023 618 | 2/1981 | European Pat. Off. . |
| 0 085 863 | 8/1983 | European Pat. Off. . |
| 023 618 | 2/1986 | European Pat. Off. . |
| 0 399 514 | 11/1990 | European Pat. Off. . |
| 1 053 173 | 3/1959 | Germany . |
| 30 25 136 | 1/1981 | Germany . |
| 94/24381 | 10/1994 | WIPO . |

*Primary Examiner*—Creighton Smith

*Attorney, Agent, or Firm*—Flynn, Thial, Boutell & Tanis, P.C.

[57] ABSTRACT

A sound-absorbing building panel for lining of the inside walls and ceilings, in particular ceiling tile, consists of a carrier panel to be arranged spaced from a wall, which carrier panel is advantageously a perforated sheet metal and to which on at least one side a sound-absorbing, microporous layer is applied. Such a building panel, which does not require an insulation layer as a backing and can, moreover, be manufactured inexpensively, has a sound-absorbing layer of granules which are surrounded on all sides by an adhesive coating. The granules are essentially designed ball-shaped and are adhesively connected together at point-like connections and to the carrier panel. The granules also have a diameter between 0.1 to 0.9 times of the hole diameter of the carrier panel.

20 Claims, 1 Drawing Sheet

SOUND-ABSORBING BUILDING PANEL

FIELD OF THE INVENTION

The invention relates to a sound-absorbing building panel for the lining of inside walls and ceilings, in particular a ceiling tile, comprising a carrier panel arranged spaced from a wall and advantageously made of a perforated sheet metal, and a sound-absorbing layer covering at least one side of the carrier panel, wherein the sound-absorbing layer consists of a microporous layer forming at least the visible side of the building panel and is fixedly connected to the carrier panel.

BACKGROUND OF THE INVENTION

Such a sound-absorbing building panel is known, for example, from the EP-B-0 023 618. The sound-absorbing building panel consists of a carrier panel made of a perforated sheet metal, wherein a sound-absorbing layer is applied to one side of the carrier panel. This sound-absorbing layer is constructed microporously, wherein a lacquer coating is applied to the outside of the microporous layer. The sound-absorbing layer consists either of a microporous foil or, however, of organic or inorganic fibers, which are connected with one another through a binding agent. Such a building panel has the advantage that with its very good sound-absorbing characteristics a backing of this building panel with additional insulating material is unnecessary. However, this known building panel is relatively expensive to manufacture, in particular with respect to the adjustment of the demanded microporosity.

SUMMARY OF THE INVENTION

The basic purpose of the invention is to provide a building panel of the above-mentioned type in such a manner that it, because of its good sound-absorbing characteristics, does not require a backing of the carrier panel with absorption materials, and that it is inexpensive to manufacture.

A sound-absorbing building panel designed according to the invention consists thus of a perforated carrier panel, wherein the hole diameter can be greatly varied, although it has been found that a hole diameter of 1.5 mm is advantageous. With such a hole diameter, the granules preferably have a diameter of 0.5 to 1 mm. Granules are applied to this carrier panel, which carrier panel consists advantageously of sheet metal and can be relatively thin, which granules are essentially of a spherical design. These granules have a diameter of 0.1 to 0.9 times of the hole diameter, and are surrounded on all sides by an adhesive coating. It has proven to be advantageous for achieving a smooth surface layer and for adjusting the necessary microporosity when the granule size diameters deviate from a medium value by only ±25%. The granules, which are essentially round, adhere approximately at point-like connections to one another due to the all around adhesive coating so that a porous layer is obtained. The microporosity of this layer, which should lie advantageously between 10 and 1,000 Rayl, can be adjusted in a simple manner through granules of larger and smaller sizes and the relationship between smaller and larger granules.

Water glass is advantageously used as the adhesive. However, any other adhesive, like also organic adhesives, can also be used. The type of the adhesive is determined by its simple applicability to the granular surface on the one hand and, on the other hand, by fire-protection regulations which may be required.

Thus for applying the adhesive same can be mixed with the granules, whereby then subsequently the granules provided with the adhesive coating can be spread over, blown onto or, however, rolled onto the panel. If a powdery water glass is utilized as the adhesive, the granules to which is added the powdery water glass can be applied in the dry state to the carrier panel, whereby then subsequently the adhesive action is caused by supplying water.

Glass balls, in particular porous glass balls, are found to be particularly advantageous, which glass balls have an essentially smooth ball design. With this it is achieved that the spaces and thus the porosity can be adjusted in a simple manner. It is here also conceivable to utilize quartz sand for the granules.

BRIEF DESCRIPTION OF THE DRAWINGS

One exemplary embodiment of the invention will be described in greater detail hereinafter in connection with the drawings, in which.

DETAILED DESCRIPTION

Figure 1:
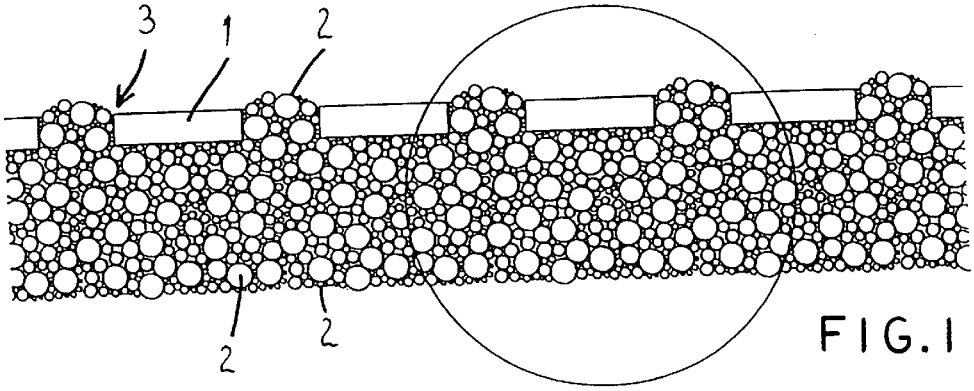
FIG. 1 is a cross-sectional view of a carrier panel designed according to the invention with a microporous layer according to the invention.
Figure 3:
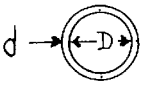
FIG. 3 illustrates an enlarged granule.
Figure 2:
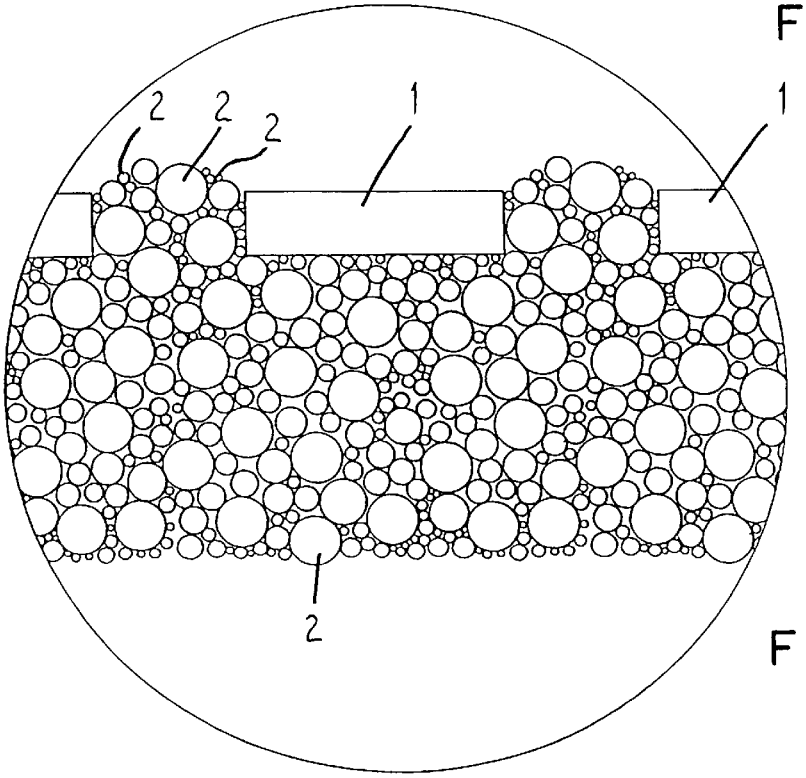
FIG. 2 illustrates an enlarged section of FIG. 1.

The sound-absorbing panel of the invention consists of a carrier panel 1 onto which granules 2 are applied, wherein the granules have an essentially ball-shaped design. Granules of varying sizes are here used and are chosen such that a porosity within the sound-absorbing layer is maintained, whereby the size of the porosity is maintained by the selection of the mixture of the selected granules.

The diameters of the granules are smaller than the openings 3 in the carrier panel 1. The thickness of the adhesive coating, which is applied to the granules, is small compared with the diameter of the granules, whereby a point-like adhesion of the granules with one another is obtained. The adhesive coating preferably has a thickness (d) defined by $d=\alpha D$, where D is the diameter of the granules in millimeters and $\alpha=0.02$—0.2. The porosity of the sound-absorbing layer can on the one hand be achieved by the selection of the mixture of the granules and the size of the granules and, on the other hand, by the thickness of the applied layer. This makes it possible to adjust the sound-absorbing characteristic of the panels to any desired level, however, same should preferably lie between 10 to 1,000 Rayl.

The embodiments of the invention in which an exclusive property or privilege is claimed are defined as follows:

It is claimed:

1. In a sound-absorbing building panel for the lining of inside walls and ceilings, comprising a carrier panel to be arranged spaced from a wall and made of a perforated sheet metal, and a sound-absorbing layer covering at least one side of the carrier panel, whereby the sound-absorbing layer comprises a microporous layer which is fixedly connected to the carrier panel and forms at least a visible side of the building panel, the improvement wherein the sound-absorbing layer is formed of granules which are surrounded on all sides by an adhesive coating, wherein the granules are essentially ball-shaped and are essentially connected together by the adhesive coating at point-like connections and to the carrier panel, and wherein a diameter of the granules lies between 0.1 to 0.9 times a hole diameter in the carrier panel.

2. The building panel according to claim 1, wherein the granules have a diameter of 0.5 to 1 mm with the hole diameter in the carrier panel being 1.5 mm.

3. The building panel according to claim 1, wherein the diameter of the granules in the layer deviates from one another at a maximum of ±25%.

4. The building panel according to claim 1, wherein the adhesive coating consists of water glass.

5. The building panel according to claim 1, wherein the adhesive coating comprises a powdery water glass activated by water.

6. The building panel according to claim 1, wherein a thickness of the adhesive coating is small compared with the diameter of the granules.

7. The building panel according to claim 1, wherein the perforated carrier panel is provided with an adhesive coating prior to applying the granules.

8. The building panel according to claim 7, wherein a thickness (d) of the adhesive coating is defined by $d=\alpha D$, wherein D is the diameter of granules in millimeters and $\alpha=0.02$—0.2.

9. The building panel according to claim 1, wherein the granules comprise of glass balls.

10. The building panel according to claim 9, wherein the glass balls are porous.

11. The building panel according to claim 1, wherein the sound-absorbing layer is covered with a porous lacquer coating.

12. A sound-absorbing building panel comprising:

a carrier panel to be arranged spaced from a wall and including perforations; and a sound-absorbing layer covering at least one side of the carrier panel, whereby the sound-absorbing layer comprises a microporous layer connected to the carrier panel and forming at least a visible side of the building panel, the sound-absorbing layer being formed of granules surrounded by an adhesive coating, wherein the granules are essentially ball-shaped and are essentially connected to each other and to the carrier panel by the adhesive coating, and have a diameter of 0.5 to 1 mm.

13. The building panel of claim 12, wherein the perforations of the carrier panel have a hole diameter of about 1.5 mm.

14. The building panel according to claim 12, wherein the diameter of the granules in the layer deviates from one another at a maximum of ±25%.

15. The building panel according to claim 12, wherein a thickness (d) of the adhesive coating is defined by $d=\alpha D$, wherein D is the diameter of granules in millimeters and $\alpha=0.02$ —0.2.

16. The building panel according to claim 12, wherein the granules comprise porous glass balls.

17. A sound-absorbing building panel comprising:

a carrier panel to be arranged spaced from a wall and made of a perforated sheet metal; and a sound-absorbing layer covering at least one side of the carrier panel, whereby the sound-absorbing layer comprises a microporous layer connected to the carrier panel, the sound-absorbing layer being formed of granules which are surrounded by an adhesive coating, wherein the granules are essentially ball-shaped and are essentially connected together by the adhesive coating, and wherein the diameter of the granules in the sound-absorbing layer deviates from one another at a maximum ±25%.

18. The building panel according to claim 17, wherein the diameter of the granules lies between 0.1 to 0.9 times of a hole diameter in the carrier panel.

19. The building panel according to claim 17, wherein a thickness (d) of the adhesive coating is defined by $d=\alpha D$, wherein D is the diameter of granules in millimeters and $\alpha=0.02$—0.2.

20. The building panel according to claim 17, wherein the granules comprise porous glass balls.

* * * * *

UNITED STATES PATENT AND TRADEMARK OFFICE

CERTIFICATE OF CORRECTION

PATENT NO : 5 910 082

DATED : June 8, 1999

INVENTOR(S) : Klaus BENDER et al

It is certified that error appears in the above-identified patent and that said Letters Patent are hereby corrected as shown below:

Title page, item [75], column 1; change "Klaus Bender, Biertal" to ---Klaus Bender, Biebertal---.

item [73], column 1; change "Wilhelmi Werke AG, Lahnua, Germany" to ---Wilhelmi Werke AG, Lahnau, Germany---.

item [56], column 2; change "Flynn, Thial, Boutell & Tanis, P.C." to ---Flynn, Thiel, Boutell & Tanis, P.C.---.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*